United States Patent [19]

Passal

[11] 4,014,761

[45] Mar. 29, 1977

[54] BRIGHT ACID ZINC PLATING

[75] Inventor: Frank Passal, Detroit, Mich.

[73] Assignee: M & T Chemicals Inc., Greenwich, Conn.

[22] Filed: Jan. 6, 1975

[21] Appl. No.: 538,602

[52] U.S. Cl. ..... 204/55 R
[51] Int. Cl.[2] ..... C25D 3/22
[58] Field of Search ..... 204/55 R, 43 Z, 44

[56] References Cited

UNITED STATES PATENTS 3,245,886 4/1966 Michael ..... 204/55 R X

*Primary Examiner*—G. L. Kaplan
*Attorney, Agent, or Firm*—Kenneth G. Wheeless; Robert P. Auber; Robert Spector

[57] ABSTRACT

This invention relates to a method of producing lustrous to brilliant zinc electrodeposits, which comprises passing current from a zinc anode to a metal cathode for a time period sufficient to deposit a lustrous to brilliant zinc electrodeposit upon said cathode; the current passing through an aqueous acidic bath composition containing at least one zinc compound providing zinc cations for electroplating zinc said zinc compound selected from the group consisting of zinc sulfate, zinc chloride and zinc sulfamate; chloride anions added as salts of bath compatible cations excepting ammonium; in the absence of complexing or chelating agents of organic nature; and containing as cooperating additives at least one polyether surfactant, at least one aromatic carbonyl compound, and, as a luster and leveling development agent, sulfonated castor oil.

22 Claims, No Drawings

BRIGHT ACID ZINC PLATING

BRIEF DESCRIPTION

This invention relates to the electrodeposition of bright zinc from an acidic electrolyte. More particularly this invention relates to improved zinc plating bath compositions, to methods of using and preparing such bath compositions and to improved surfaces having bright zinc electrodeposits thereon.

This invention relates to a method of producing lustrous to brilliant zinc electrodeposits, which comprises passing current from a zinc anode to a metal cathode for a time period sufficient to deposit a lustrous to brilliant zinc electrodeposit upon said cathode; said zinc compound selected from the group consisting of zinc sulfate, zinc chloride and zinc sulfamate; chloride anions added as salts of bath compatible cations excepting ammonium; in the absence of complexing or chelating agents of organic nature; and containing as cooperating additives at least one polyether surfactant, at least one aromatic carbonyl compound, and, as a luster and leveling development agent, sulfonated castor oil.

The deposit of this invention is a lustrous to brilliant zinc which is smooth, relatively ductile, low in internal stress, having low tarnishing tendencies and good receptivity to conversion coatings.

In the prior art of electrodepositing zinc in the acidic pH range (below 7) the bath generally consists of a zinc salt; chloride generally added as ammonium chloride; ammonium generally added as the chloride or sulfate; a complexing or chelating agent generally of organic nature and consisting of a hydroxycarboxylate or an amine or an aliphatic amine carboxylate; together with grain refining or brightening additives consisting of a polyether surfactant, usually of non-ionic nature, and a brightener consisting of a N-heterocycle, lower valent sulfur compound or a variety of aromatic carbonyl compounds. Although the baths of the prior art are claimed to give semi-bright to full bright deposits, the deposits are generally quite brittle and may have questionable adhesion when applied to ferrous basis metals for rust-proofing and/or decorative purposes. In addition the electrolytes are generally very corrosive due to the presence of the ammonium cation which results in extensive corrosive attack of plating tank and auxiliary equipment; the deposits also, as they are withdrawn from the plating bath and prior to water rinsing may, and usually do, suffer attack by the solution resulting in blotchiness etc. which particularly manifests itself in poor apearance after application of conversion coating films by immersion in hexavalent chromium-containing proprietary treatment baths. Also in the presence of ammonium and other nitrogenous compounds in the plating bath the deposits after removal from the plating bath are extremely chemically active and will rapidly tarnish and darken on standing even after application of conversion coatings so that the overall appearance deteriorates and detracts from eye-appeal. Also the presence of complexing and chelating agents, usually present in substantial proportion of the total bath ingredient concentration, may interfere with waste disposal treatment processes, especially if effluents from a variety of electroplating baths converge into the treatment process, because of the solubilizing effect of the complexing and chelating agents on a variety of metal compounds which normally would precipitate out in form of sludge which is removed by sedimentation, filtration, etc. and suitably disposed of.

Generally, because of additive mechanisms and interactions which are not well understood, it is necessary to have in the baths ammonium and other nitrogenous compounds in order to obtain adequate grain-refining and brightening response from N-heterocyclics, aromatic carbonyl, etc. compounds in cooperation with polyether surfactants. In the absence of nitrogenous compounds deposits may lack luster, uniformity of appearance and may have an objectionable dark, usually yellowish or brownish, cast which is unsightly and interferes with optimum appearance. Such unsightly appearance, in addition, may not be counteracted sufficiently enough by the usual chemical polishing action of conversion coating treatments.

The present invention has the purpose of overcoming the deficiencies of the prior art baths cited and discussed in the above. This is accomplished by incorporating in the bath a "sulfonated" or "sulfated" castor oil (also known as Turkey Red Oil) in the bath. By the use of such an additive one may eliminate the use of nitrogenous and chelating or complexing additives and still obtain excellent grain-refining and brightening response from cooperative use of polyether surfactants and such compounds as aromatic carbonyl compounds. As a result the deposits are relatively ductile, may have high specular reflectivity, are generally low tensile or compressively stressed, are not attacked by the plating electrolyte which becomes substantially less corrosive, take conversion coating excellently, have good adhesion characteristics and do not darken or otherwise discolor after water rinsing and drying either in the as-plated condition or after conversion coating treatment.

The main functions of the polyether surfactant are to provide some grain refinement and, very important, to solubilize or disperse other additives such as sulfonated castor oil and aromatic carbonyl compounds. The concentration of the polyether surfactant must be high enough, particularly, to relate to the concentrations of the other additives used, otherwise the latter may "oil-out" causing serious deposit defects such as only partial coverage of the surface being plated with zinc; serious striation, pitting or "ribbing" of zinc deposits; and difficulty in removal by water rinsing of oily films, gel-like precipitates, etc. which may adhere to the plated surface on withdrawing the article being plated from the plating bath.

DETAILED DESCRIPTION

This invention relates to a method of producing lustrous to brilliant zinc electrodeposits, which comprises passing current from a zinc anode of a metal cathode for a time period sufficient to deposit a lustrous to brilliant zinc electrodeposit upon said cathode; the current passing through an aqueous acidic bath composition containing at least one zinc compound providing zinc cations for electroplating zinc; said zinc compound selected from the group consisting of zinc sulfate, zinc chloride and zinc sulfamate; chloride anions added as salts of bath compatible cations excepting ammonium, in the absence of complexing or chelating agents of organic nature; and containing as cooperating additives at least one polyether surfactant, at least one aromatic carbonyl compound, and, as a luster and leveling development agent, sulfonated castor oil.

Castor oil is generally considered to consist of diglycerides of ricinoleic acid 80–86%, oleic acid 7–9%, linoleic acid 3 to 3.5%, stearic acid 0.3% and dihydroxystearic acid 0.6–1.8%. The unsaponifiable fraction (less than 1%) contains tocopherols amounting to 0.05% of the oil. Sulfonated or Sulfated Castor Oil is a reaction product of Castor Oil with $H_2SO_4$, $SO_3$, etc. and is generally considered to be the product of reaction of $H_2SO_4$, $SO_3$, etc. with the hydroxy group of the ricinoleic moiety (12-hydroxy-9-octa-decenoic acid, $C_{18}H_{34}O_3$) to actually form the sulfated ester. A typical specification of sulfonated castor oil is the following:

| | Minimum | | Maximum |
|---|---|---|---|
| % Moisture | 52 | | 53 |
| % Cold Test | | 50 | |
| % Actual Fat | | 40 | |
| % Ignited Ash | 7 | | 8 |
| % Combined $SO_3$ | | 2.25 | |
| pH (1% solution) | | 8.0 | |
| Specific Gravity | | 1.03 | |
| % Free Sulfate ($SO_4$) | | 0.25 | |

Preferred concentration limits for Sulfonated Castor Oil used in this invention are about 0.1 to 2 grams per liter.

Alternatively, the sulfonated castor oil may be the product sold commercially as "Parapon SA" by the Arkansas Co., Inc. of 185 Foundry Street, Newark, N.J., containing 36 to 37% by weight of sulfonated castor oil having 14 to 16% combined $SO_3$. Other sulfonated or sulfated castor oils having other $SO_3$ contents are available commercially and have been found suitable for the purpose of this invention.

In a separate preferred embodiment of this invention it has been unexpectedly found that in replacing Zinc Sulfamate for Zinc Sulfate or Zinc Chloride, not only were the excellent cathode deposit characteristics retained but the anode performance was dramatically improved. It is not clear why sulfamate should be much superior to the sulfate and chloride anions in this respect since one would not normally consider sulfamate as a complexing, chelating or anode-solubilizing anion. The explanation may be that zinc sulfamate may be considerably more soluble than the sulfate or chloride salts or may prevent or inhibit formation thereby of basic zinc salt anode incrustations. Zinc Oxide and Sulfamic Acid may be interacted in water in a mole ratio of 1 to 2 respectively to form Zinc Sulfamate.

$$ZnO + 2NH_2SO_3H \rightarrow ZN(O_3SNH_2) + H_2O$$

Using zinc sulfamate to provide both excellent anode and cathode plating characteristics results in a unique system with outstanding advantages over existing processes. The preferred embodiment is of particular advantage for rack plating applications where suspended matter is of more concern than for barrel plating purposes.

The zinc sulfamate may be introduced by interaction of zinc oxide and sulfamic acid in the preparation of the plating bath or may be used as a liquid concentrate to be used by suitable dilution to a desired working concentration and the addition of other bath ingredients such as NaCl, $H_3BO_3$ and organic-type additives. A typical concentrate may be prepared which in use would involve diluting 1 part by volume with 3 parts by volume of water.

For addition to the zinc electroplating bath the sulfonated castor oil is used in the form of an aqueous stock solution, in which it is highly soluble, or may be admixed with an aqueous stock solution of the polyether surfactant which in addition may contain grain-refining or brightening agents.

The polyether surfactant may be completely nonionic or may have also, in addition to polyether groups, anionic or cationic or mixed anionic-cationic moieties. Preferred compounds are the following.

$$H_3C-(CH_2)_n-COO\,(CH_2\underset{\underset{R}{|}}{C}HO)_x-H \qquad (a)$$

where
n and X = 10 – 20
R = H or $CH_3$ $$R-(CH_2\underset{\underset{R'}{|}}{C}HO)_x\,(CH_2CH_2O)_yH \qquad (b)$$

where
R′ = methyl ($CH_3$)
R = alkyl straight or branched chain containing 10 – 18 (atoms)
X = 2 to 5
Y = 10 to 20

$$HO\,(CH_2\underset{\underset{R}{|}}{C}HO)_xH \qquad (c)$$

where
R = H or $CH_3$
X = an integer to give a Molecular Weight of 300 to 1000

(d)

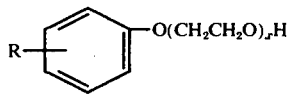

where
R = straight C chain having 9 – 18 atoms of C
X = 10 – 20

Preferred concentration limits of the polyether surfactants, which may be used singly or in combination, are about 1 to 30 grams per liter.

Typical aromatic carbonyl compounds which are effective in the practice of this invention are the following.

(a)

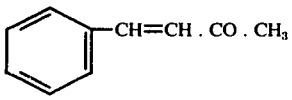

Benzylidene Acetone (or Benzalacetone)

-continued

| | | |
|---|---|---|
| (b) |  | Furfuryl Acetone |
| (c) | 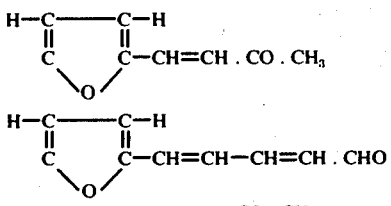 | Furfuryl Crotonaldehyde |
| (d) | 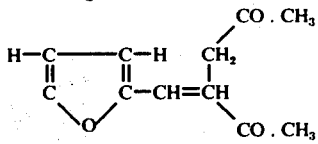 | Furfuryl Acetonylacetone |

Preferred concentration limits of aromatic carbonyl compounds operable in the practice of this invention are about 0.025 to 1 gram per liter.

Before adding the organic additives the zinc plating bath may be prepared using zinc sulfate, zinc chloride or zinc sulfamate as the source of zinc; additional chloride anion for purposes of increasing conductivity and promoting good anode corrosion may be introduced as salts such as sodium chloride, potassium chloride, aluminum chloride, magnesium chloride, calcium chloride, etc. i.e. chloride salts the cations of which are bath and process compatible and which do not include as cations ammonium or amine moieties. Boric Acid is advantageous as a pH buffer.

The operating temperature of the baths are ambient temperatures ranging, say, from 15 to 40° C. Agitation is preferably of the moving cathode rod type or even involving the use of air, the latter if the polyether surfactant permits it by being of low foaming type.

Anodes generally consist of 99.99+ pure zinc which may be immersed in the plating bath in baskets made of an inert metal such as titanium or which may be suspended in the bath by hooks hanging on the anode bar made of an inert metal such as titanium.

The plating baths may be used for rack or barrel plating purposes. The basis metals generally plated are ferrous metals such as steel or cast iron to be zinc plated for protection against rusting by a cathodic protection mechanism and also for providing decorative eye appeal. To further enhance the protective action of the zinc the zinc after plating may be subjected to a conversion coating treatment, generally by immersion or anodic electrolytic action in baths containing hexavalent chromium, catalysts, accelerators, etc. The conversion coating treatment may enhance the luster of the zinc as plated by a chemical or electropolishing action as well as providing a conversion coating film consisting of a mixture of CR VI, Cr III and Zn compounds ranging in color from very light iridescent, to blue, to iridescent yellow to olive drab etc. The more highly colored coatings are thicker and may provide better corrosion protection in humid, saline atmospheres. To further enhance protective action, usually on the more transparent, lighter colored films, there may be applied lacquer, coatings, air dried or baked. To some of the thinner, lighter-colored conversion coating there may be applied a more intense and varied color by immersion in solutions of suitable dyestuffs to give pure jet black to pastel range of colors which may then be followed by lacquer coatings to apply protection against abrasion, finger staining etc. in use.

Although the concentration of salts in preparing plating baths is not too critical there are certain concentrations not to be exceeded, which can only be determined by actual experimentation, otherwise some of the organic additives, particularly the sulfonated castor oil, may salt or oil out resulting in deleterious effects on appearance, uniformity, continuity etc. of the zinc deposits as well as on their luster and nature of grain refinement. Similarly the actual and relative salt concentrations must be so chosen, again based on experimentation, to provide maximum deposit ductility and adhesion and a minimum of tensile stress in order to avoid spontaneous peeling, exfoliation or spalling of deposits after plating and in use applications. Because of these factors wide limits of concentration of individual bath ingredients cannot be given as well as relative concentrations of several basic bath ingredients. Some general criteria of basic bath formulation, based on extensive bath formulation observations, are that very high zinc and chloride contents should be avoided since they may adversely affect compatability with organic additives and physical properties of deposits.

The operating pH of the baths when properly formulated is not critical and may range, say, from about 2.5 to about 5.5 with a preferred range of about 3.5 to 4.5.

Cathode current densities may range from about 0.1 to 5.0 amperes per square decimeter (ASD) depending on whether the plating is done in barrels or on racks and on such factors as concentration of bath zinc metal, conducting salts, buffers etc. and on the degree of cathode agitation. Anode current densities also may range from about 0.5 to 3.0 ASD depending on bath ingredient concentrations, degree of solution circulation around the anodes etc.

The bath cations preferably consist of Zn and Na; bath anions are preferably $SO_4^{-2}$ or $Cl^{-1}$ or $NH_2SO_3^{-1}$ and may consist of combinations thereof. Certain anions such as acetate have been found to have a very definite harmful effect on bath performance for reasons which are not well understood. Such deleterious effects may be non-uniformity of deposit luster and formation of off-color yellowish to brownish yellow colors and excessive graininess of deposit which normally cannot be counteracted by subsequent conversion coating treatment.

The plating baths are relatively tolerant to metallic impurities such as iron which are liable to be introduced and many such as iron form basic salt precipitates which can be filtered out thus making the bath self purging with respect to such impurities.

Several typical bath compositions which have given excellent results both in Hull Cell and 4-liter life tests have been the following:

| | | | RANGE |
|---|---|---|---|
| (a) | $ZnSO_4 \cdot 7H_2O$ | 160 g/l | 150–175 g/l |
| | NaCl | 30 g/l | 25–40 g/l |
| | $H_3BO_3$ | 25 g/l | 20–35 g/l |
| (b) | $ZnCl_2$ | 75 g/l | 70–90 g/l |
| | $H_3BO_3$ | 25 g/l | 20–35 g/l |
| (c) | $Zn(O_3SNH_2)_2$ | 144 g/l | 100–200 g/l |
| | NaCl | 30 g/l | 25–40 g/l |
| | Boric Acid | 25 g/l | 20–35 g/l |

The following examples are submitted for the purpose of illustration only and are not to be construed as limiting the scope of the invention in any way.

Hull Cell tests were run under conditions described as follows and the deposits were examined along a line 2.54 cm from and parallel to the bottom edge of the Hull Cell panel.

A polished brass or steel panel was scribed with a horizontal single pass of 4/0 grit emery to give a band width of about 1 cm at a distance of about 2.5 cm from the bottom of the panel. After suitably cleaning the panel it was plated in a 267 ml. Hull Cell, at a 1 ampere cell current for 5 minutes, at a temperature of 20° C. using magnetic stirring, and a 99.99+ pure zinc sheet as an anode.

EXAMPLE 1

To 250 ml. of bath (a) there were added the following additives.

Polyether Surfactant - $CH_3(CH_2)_2(CH_2\overset{\overset{CH_3}{|}}{C}HO)_3(CH_2CH_2O)_{15}H$ - 10 g/l Benzalacetone - 0.2 g/l A Hull Cell panel was run on the bath after adjusting the pH to 4.0 and the deposit was fairly fine grained but excessively milky and somewhat non-uniform.

On adding 0.44 g/l of sulfonated castor oil and repeating the Hull Cell test a brilliant deposit with fairly good low current density coverage was obtained throughout the entire current density range (about 0 to 6 ASD).

EXAMPLE 2

The Hull Cell test of Example 1 was repeated using as the Polyether Surfactant 1 g/l of the following compound.

$HO(CH_2\underset{\underset{CH_3}{|}}{C}HO)_2H$ - Molecular Weight about 710.

The results obtained were essentially the same as those for Example 1.

EXAMPLE 3

To 250 ml. of bath (b) there were added the same surfactant and concentration as for Example 1 and the same concentration of Benzalacetone and the pH was adjusted to 4.0.

The Hull Cell panel then run was similar to that corresponding one of Example 1. On then adding 0.44 g/l sulfonated castor oil a uniformly lustrous deposit was obtained having a slight uniform haze. On dipping the bottom half of the second Hull Cell panel in a dilute conversion coating treatment bath formulated to give a chemical polish of the slightly iridescent "blue" type the haze was removed and the treated surface was essentially specularly reflective.

EXAMPLE 4

Using the bath and the additive types and concentrations of Example 1 but using 0.1 g/l Furfural Acetone in place of 0.2 g/l Benzalacetone essentially the same results as in Example 1 were obtained.

EXAMPLE 5

Using the bath and the additive types and concentrations of Example 1 but using 0.1 g/l Furfuryl Acetonylacetone in place of 0.2 g/l Benzalacetone essentially the same results as in Example 1 were obtained.

EXAMPLE 6

Using the bath and the additive types and concentrations of Example 1 but using 0.1 g/l Furfuryl Crotonaldehyde in place of 0.2 g/l Benzalacetone essentially the same results as in Example 1 were obtained except that the deposit had a slight brownish-yellow uniform cast which was changed to high specular reflectivity by a subsequent conversion coating treatment of the bottom half of the panel as described in Example 3.

EXAMPLE 7

Example 1 was repeated using bath (c) in place of bath (a) with essentially the same sequential results obtained.

EXAMPLE 8

The bath of Example 1 was then subjected to a 4-liter life test using conditions as follows.

Plating cell — 5 liter rectangular cross-section (13 cm × 15 cm) made of Pyrex.

Solution volume — 4 liters to give a solution depth, in absence of anode, of about 20.5 cm.

Temperature — 20° C. (maintained by immersing cell in a thermostatically controlled water bath).

Agitation — moving cathode bar.

Anode — 99.99+ zinc balls, 5 cm in diameter strung on titanium wire — 5 balls per cell.

Cathode — brass strip (2.54 cm × 20.3 cm × 0.071 cm) buffed and polished on one side and immersed to a depth of about 17.8 cm — horizontal bend 2.54 cm from bottom and the next 2.54 cm bent to give an internal angle on the polished side of cathode of about 45° — polished side facing anode at an approximate distance of 10.2 cm and scribed vertically in center with a 1 cm wide band of a single pass of 4/0 grit emery paper scratches.

Cell current — 2.0 amperes.

Time — 10 minutes to 8 hours per day.

Filtration — occasional batch.

The 4-liter life test was run for a total of 450 ampere-hours of electrolysis. Some deposits were plated for 10 to 15 minutes to give normally utilized thicknesses of zinc (0.2 to 0.5 mils or 5.1 to 12.7 microns) while other deposits were plated for as long as 7 to 8 hours to observe physical properties such as ductility, tensile stress etc. and to provide sufficient electrolysis to deplete some of the organic additives. Uniformly highly lustrous, compressively stressed, relatively ductile, non-exfoliated or cracked, deposits were consistently obtained which did not tarnish after plating or after conversion coating treatment. The additive consumed and replenished was Benzalacetone, which, after the bath had stabilized was consumed at an approximate rate of about 0.2 gram per 15 ampere-hours. The deposits exhibited good leveling characteristics.

EXAMPLE 9

A 4-liter life test was run for a total of about 250 ampere-hours on the bath of Example 3 with essentially the same results as for Example 8 except that the deposits were slightly less bright and uniform in appearance due to a slight non-uniform haze which could be removed by a conversion coating treatment. The deposits were of practically zero stress and exhibited very good leveling and good ductility with no tendency toward deposit exfoliation, tarnishing or cracking.

EXAMPLE 10

A 4-liter life test was run for a total of about 250 ampere-hours on the bath of Example 7 with essentially the same results as for Examples 8 and 9. However the anode corrosion characteristics with respect to absence of salt etc. incrustations were much superior to those for Examples 8 and 9 resulting in much less suspended matter and a cleaner electrolyte.

EXAMPLE 11

Preparation of Sulfamate Zinc Concentrate $$ZnO + 2\,NH_2SO_3H \longrightarrow Zn(SO_3NH_2)_2 + H_2O$$

81.38 (2) (97.09) 257.56

200 g. ZnO (19.2 g. excess) was suspended in 500 ml. water and while stirring magnetically added 430.8 grams Sulfamic Acid (Eastman Practical) — stirred until pH about 4.4 (Paul Frank pH papers) — treated with 3 g. activated carbon — filtered (filtrate 850 ml.) — diluted to 1 liter with water — pH 4.4 —Specific Gravity = 1.355.

Nominal Concentrations.

Zn — 146 g/l

Sulfamate — 423 g/l

When 1 part diluted with 3 parts water by volume the foregoing should give 36.4 g/l Zn and 105.7 g/l Sulfamate.

Although this invention has been illustrated by reference to specific embodiments, modifications thereof which are clearly within the scope of the invention will be apparent to those skilled in the art.

I claim:

1. A method for producing lustrous to brilliant zinc electrodeposits which comprises passing current from a zinc anode to a metal cathode the current passing through an aqueous acidic bath composition containing at least one zinc compound providing zinc cations for electroplating zinc said zinc compound selected from the group consisting of zinc sulfate, zinc chloride and zinc sulfamate; chloride anions added as salts of bath compatible cations excepting ammonium; in the absence of complexing or chelating agents of organic nature; and containing as cooperating additives from 1 to 30 grams per liter of at least one polyether surfactant, 0.025 to 1.0 gram per liter of at least one aromatic carbonyl compound, and, as a luster and leveling development agent, 0.1 to 2.0 grams per liter of sulfonated castor oil.

2. The process of claim 1 wherein at least one zinc compound is selected from zinc sulfate, zinc chloride and mixtures thereof.

3. The process of claim 1 wherein said zinc compound is zinc sulfamate.

4. The process of claim 1 wherein said polyether surfactant exhibits the formula:

$$H_3C-(CH_2)_n-COO(CH_2\underset{\underset{R}{|}}{C}HO)_x-H$$

where $n$ is an integer of from 10 to 20, and

R is hydrogen or methyl, and

X is an integer of from 10 to 20.

5. The process of claim 1 wherein said polyether surfactant exhibits the formula:

$$R-(CH_2\underset{\underset{R'}{|}}{C}HO)_x\,(CH_2CH_2O)_y\,H$$

where

R′ is methyl ($CH_3$),

R is an alkyl straight or branched carbon chain containing 10 to 18 carbon (atoms), $x$ is an integer of from 2 to 5, and $y$ is an integer of from 10 to 20.

6. The process of claim 1 wherein said polyether surfactant exhibits the formula:

$$HO\,(CH_2\underset{\underset{R}{|}}{C}HO)_x\,H$$

where

R is hydrogen or methyl, and $x$ is an integer to give a Molecular Weight of 300 to 1000.

7. The process of claim 1 wherein said polyether surfactant exhibits the formula:

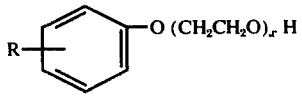

where

R is a straight carbon chain having 9 to 18 atoms of carbon, and $x$ is an integer of from 10 to 20.

8. The process of claim 1 wherein said aromatic carbonyl compound is benzylidene acetone.

9. The process of claim 1 wherein said aromatic carbonyl compound is furfuryl acetone.

10. The process of claim 1 wherein said aromatic carbonyl compound is furfuryl crotonaldehyde.

11. The process of claim 1 wherein said aromatic carbonyl compound is furfuryl acetonylacetone.

12. An aqueous acidic plating solution containing at least one zinc compound providing zinc cations for electroplating zinc said zinc compound selected from the group consisting of zinc sulfate, zinc chloride and zinc sulfamate; chloride anions added as salts of bath compatible cations excepting ammonium; in the absence of complexing or chelating agents of organic nature; and containing as cooperating additives from 1 to 30 grams per liter of at least one polyether surfactant, 0.025 to 1.0 gram per liter of at least one aromatic carbonyl compound, and, as a luster and leveling development agent, 0.1 to 2.0 grams per liter of sulfonated castor oil.

13. The composition of claim 12 wherein at least one zinc compound is selected from zinc sulfate, zinc chloride and mixtures thereof.

14. The composition of claim 12 wherein said zinc compound is zinc sulfamate.

15. The composition of claim 12 wherein said polyether surfactant exhibits the formula:

$$H_3C-(CH_2)_n-COO(CH_2\underset{\underset{R}{|}}{C}HO)_x-H$$

where $n$ is an integer of from 10 to 20,

R is hydrogen or methyl, and $x$ is an integer of from 10 to 20.

16. The composition of claim 12 wherein said polyether surfactant exhibits the formula:

$$R-(CH_2\underset{\underset{R'}{|}}{C}HO)_x\,(CH_2CH_2O)_y\,H$$

where

R′ is methyl ($CH_3$),

R is a straight or branched alkyl chain containing 10 to 18 carbon (atoms), $x$ is an integer of from 2 to 5, and $y$ is an integer of from 10 to 20.

17. The composition of claim 12 wherein said polyether surfactant exhibits the formula:

$$HO\,(CH_2\underset{\underset{R}{|}}{C}HO)_x\,H$$

where

R is hydrogen or methyl, and $x$ is an integer to give a Molecular weight of 300 to 1000.

18. The composition of claim 12 wherein said polyether surfactant exhibits the formula:

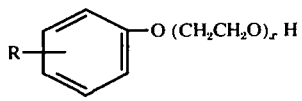

where

R is a straight carbon chain having 9 to 18 atoms of carbon, and $x$ is an integer of from 10 to 20.

19. The composition of claim 12 wherein said aromatic carbonyl compound is benzylidene acetone.

20. The composition of claim 12 wherein said aromatic carbonyl compound is furfuryl acetone.

21. The composition of claim 12 wherein said aromatic carbonyl compound is furfuryl crotonaldehyde.

22. The composition of claim 12 wherein said aromatic carbonyl compound is furfuryl acetonylacetone.

* * * * *